US005084960A

United States Patent [19]

Yeomans

[11] Patent Number: 5,084,960

[45] Date of Patent: Feb. 4, 1992

[54] APPARATUS FOR TERMINATING WIRES TO TERMINALS

[75] Inventor: Michael A. Yeomans, Camp Hill, Pa.

[73] Assignee: AMP Incorporated, Harrisburg, Pa.

[21] Appl. No.: 647,115

[22] Filed: Jan. 24, 1991

[51] Int. Cl.[5] ..... H01R 43/04

[52] U.S. Cl. ..... 29/753; 29/564.8

[58] Field of Search ..... 29/753, 751, 715, 714, 29/564.4, 564.6, 564.8

[56] References Cited

U.S. PATENT DOCUMENTS 4,587,725 5/1986 Ogawa et al. ..... 29/753

4,879,934 11/1989 Adlon et al. ..... 83/76.9

4,916,810 4/1990 Yeomans ..... 29/863

*Primary Examiner*—Carl E. Hall

*Attorney, Agent, or Firm*—James M. Trygg

[57] ABSTRACT

An automated machine, such as a cable making machine, for terminating wires to terminals. The machine includes mechanisms for selecting a desired wire type and terminal applicator, and then for automatically setting the applicator to the proper insulation crimp height corresponding to the selected wire type and terminal type combination. The insulation crimp height may then be reset to another value for a subsequently selected different wire type.

5 Claims, 4 Drawing Sheets 12
10
66
22
16
2
2
72
50
26
60
20
14

APPARATUS FOR TERMINATING WIRES TO TERMINALS

This invention relates to the termination of wires to respective terminals and the automatic setting of the insulation crimp height.

BACKGROUND OF THE INVENTION

The most common of automated machines for terminating wires to terminals are those that feed a single wire from a reel of wire to a cutting station for severing into segments. One or both ends of these wire segments are usually terminated to terminals which include crimping a first portion of the terminal to the conductor of the wire segments and a second portion of the terminal to the insulation of the wire segments. Such machines are set up to process a given type and size of wire for a particular production run, and the terminal applicators are manually adjusted for the wire crimp height and insulation crimp height, neither of which need be changed until an out of tolerance condition exists or another production run set up is initiated with a different type or size wire. Other automated machines, such as is disclosed in U.S. Pat. No. 4,879,934 which issued Nov. 14, 1989 to Adlon et al. and U.S. Pat. application Ser. No. 477,185, which was filed on Feb. 5, 1990 and assigned to the Assignee of the present invention, both of which are incorporated by reference as if set forth verbatim herein, have the capability of selecting a wire to be terminated from a supply of several different wire types and sizes. Such machines include a number of terminal applicators and associated presses so that the selected wire may be terminated to a desired terminal that is appropriate for the type and size of the wire. However, as with the single wire machines, the wire crimp height and insulation crimp height are manually set so that as different wire types or sizes are selected, they must be presented to the appropriate applicator for termination. There is no means by which the wire crimp height or insulation crimp height can be reset during production to accommodate wires of differing sizes and types. Such a means for fine adjusting the crimp height to keep it within tolerance during production is disclosed in U.S. Pat. No. 4,916,810 which issued Apr. 17, 1990 to Yeomans, and is incorporated by reference as if set forth verbation herein. The Yeomans disclosure, however, does not show the function of identifying a subsequent different wire and automatically resetting the crimp height for the different wire.

The present invention performs this function with respect to automatically adjusting the insulation crimp height in response to the selection of a wire that requires an insulation crimp height different than that of the previously selected wire.

SUMMARY OF THE INVENTION

The present invention is an apparatus for automatically setting the insulation crimp height of a terminal applicator in an automated machine for attaching a terminal to an insulated wire. A portion of the terminal is crimped to the conductor of the wire and a portion is crimped to the insulation of the wire. The automated machine includes a press having a base upon which an applicator is positioned and a ram arranged for reciprocating motion toward and away from said base. The ram is operationally coupled to the applicator for effecting the crimping of both portions of the terminal. The applicator includes an operable control for adjusting the insulation crimp height and is arranged to undergo reciprocating motion in concert with the ram. Means is provided for automatically setting the operable control of the applicator to a desired insulation crimp height. This means includes an actuator and a coupling means for drivingly coupling the actuator to the manually operable control for effecting the adjusting. A controller is also provided for determining the desired insulation crimp height and for causing the actuator to effect the automatic adjusting of the manually operable control to the desired crimp height.

DESCRIPTION OF THE PREFERRED EMBODIMENT

Figure 1:
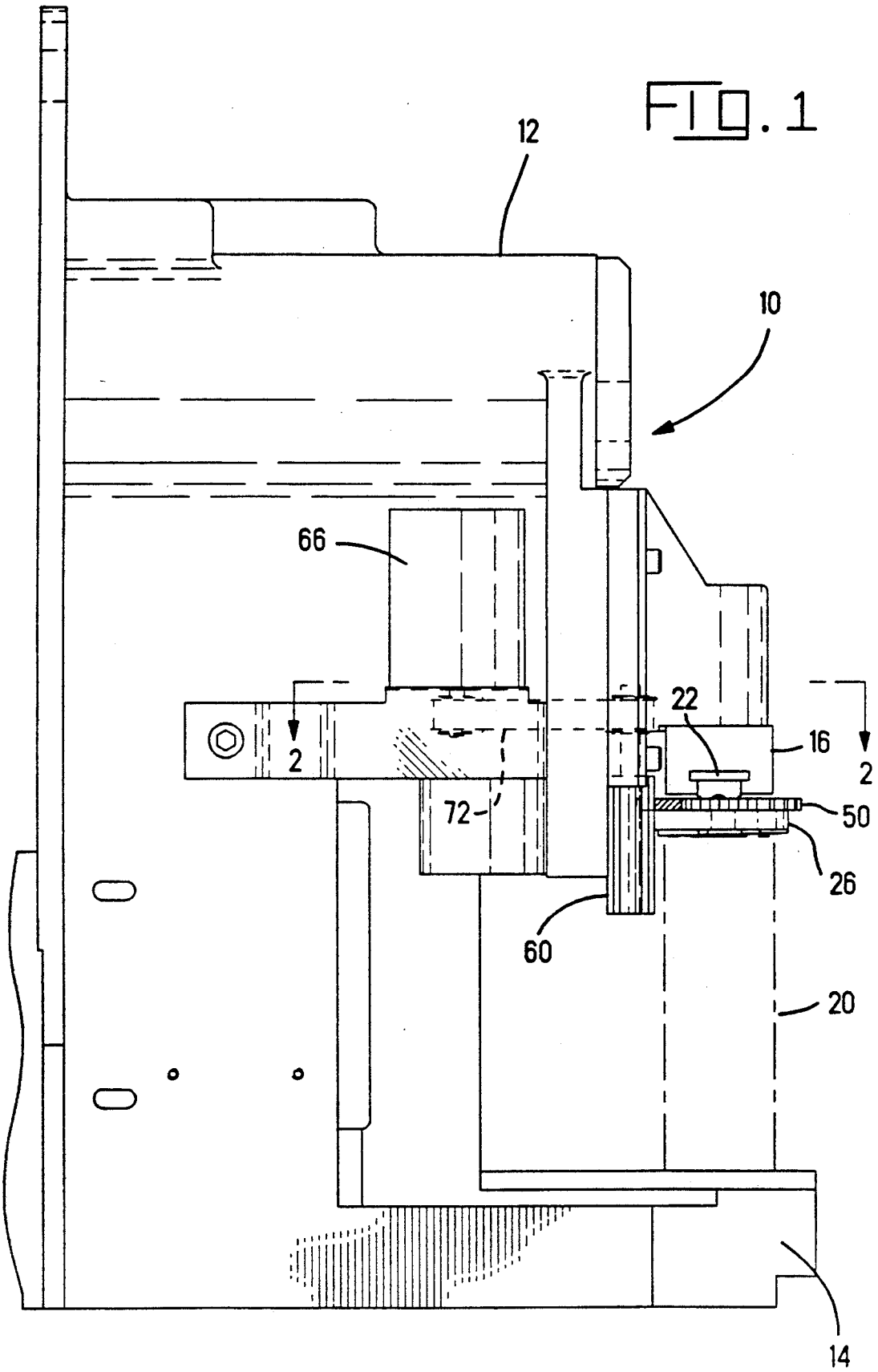
FIG. 1 is a side view of a portion of an automated machine for terminating wires to terminals incorporating the teachings of the present invention.
Figure 2:
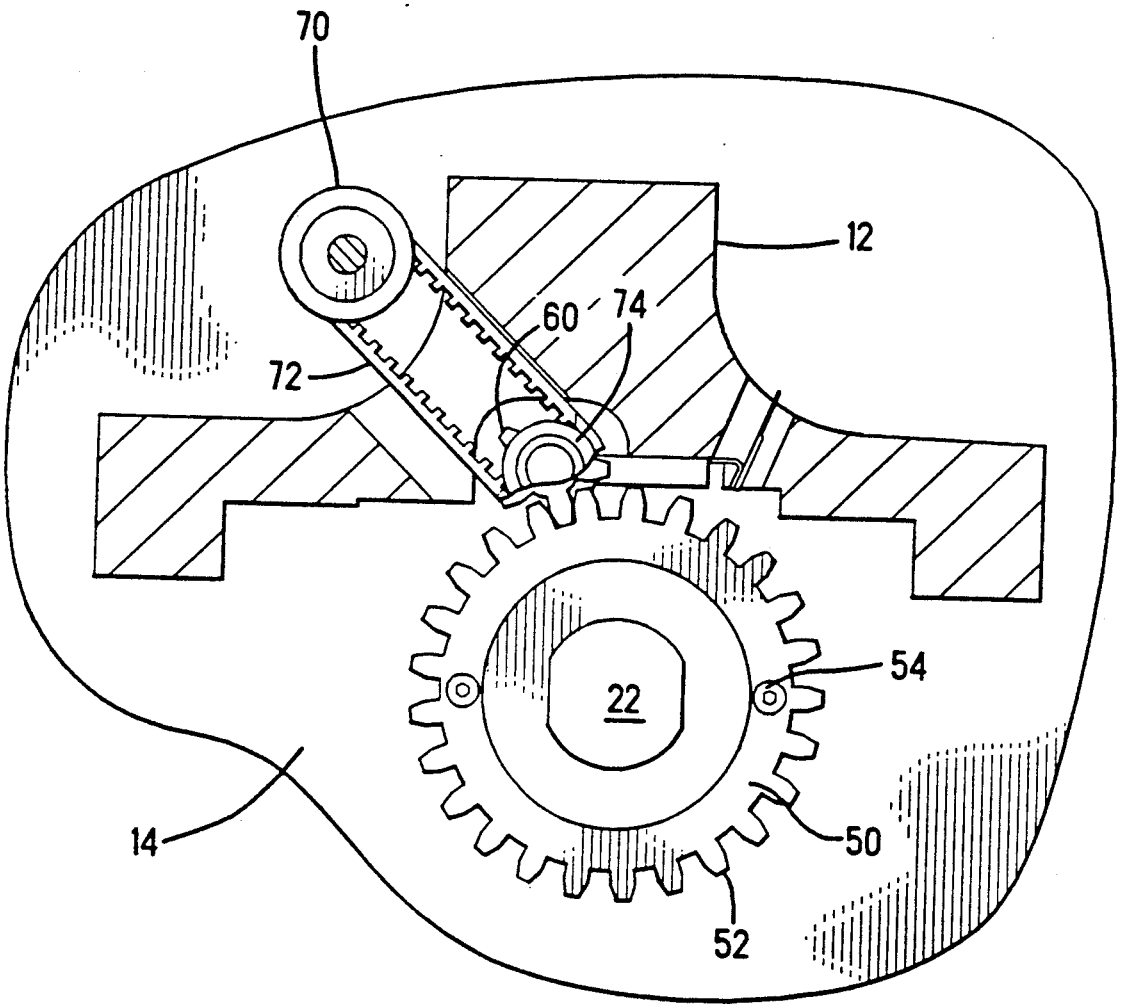
FIG. 2 is a partial cross-sectional view taken along the lines 2—2 of FIG. 1.
Figure 3:
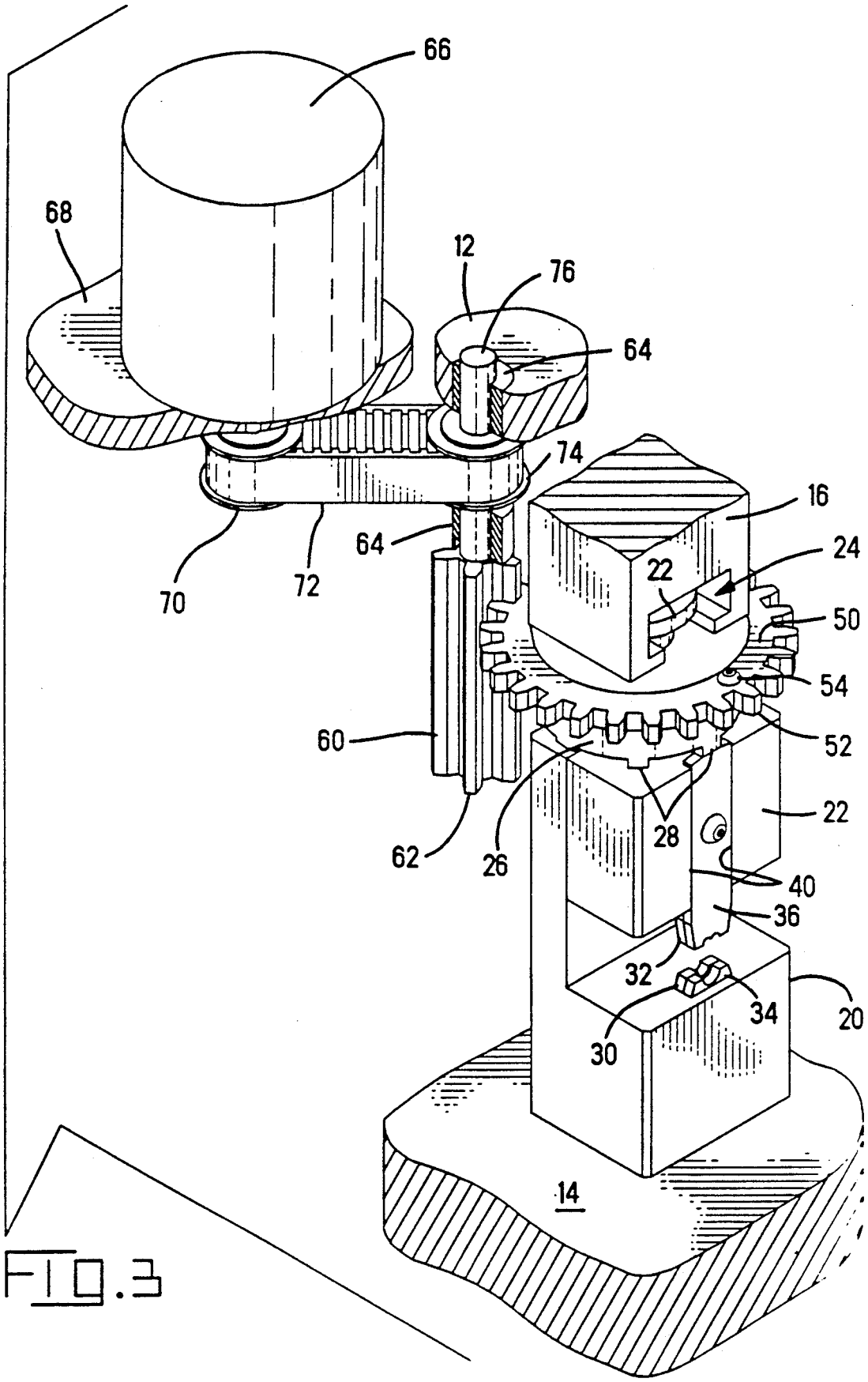
FIG. 3 is an isometric view showing the insulation crimp height adjusting mechanism of the machine shown in FIG. 1.

There is shown in FIG. 1 an automated machine 10 for terminating wires to terminals including a frame 12, a base 14 and a press ram 16 arranged for reciprocating motion toward and away from the base 14. An applicator 20, shown in phantom lines in FIG. 1 and solid lines in FIG. 3, is arranged on the base 14 with its applicator ram 22 coupled to a T-slot 24 in the press ram 16 for reciprocation therewith in the usual manner. The applicator 20 includes an operable control wheel 26 having several pads 28 of varying thicknesses arranged on one of its surfaces. These pads are used to set the height of the insulation crimp in a manner that is well known in the art. Very briefly, the applicator 20 includes a wire crimping anvil 30 and associated punch 32 and an insulation crimping anvil 34 and associated punch 36. The punches 32 and 36 are carried by and reciprocate with the applicator ram 22, and are free to move vertically a small amount within guideways 40 which are formed in the ram 22. In the case of the punch 36, this vertical movement is limited by the pads 28 of the operable control wheel 26. Each pad 28 has a thickness that corresponds to a different insulation crimp height. By manipulating the control wheel 26, any desired pad 28 may be brought into alignment to limit the vertical movement of the punch 36 and thereby set the insulation crimp height to a desired value.

A spur gear 50, having peripherally disposed gear teeth 52, is attached to the control wheel 26 by the screw fasteners 54, as shown in FIG. 3. The spur gear 50 is arranged concentric with the control wheel 26 for mutual rotation therewith and will undergo vertical reciprocating movement along with the applicator ram 22. A pinion 60 having gear teeth 62 in operational engagement with the spur gear 50, is journeled for rotation within the frame 12 by means of the bearings 64. The axis of the pinion 60 is arranged parallel with the vertical reciprocating movement of the applicator ram 22. An actuator 66, which in the present example is a stepper motor, is mounted to the frame 12 by means of a bracket 68. The output shaft of the stepper motor 66 has a pully 70 attached thereto that is in driving engagement with a flexible timing belt 72 which in turn is in driving engagement with another pully 74 that is rigidly attached to the shank 76 of the pinion 60. The teeth 62 of the pinion 60 must be sufficiently long so that operational engagement of the teeth of the pinion and spur gears is maintained during the reciprocating movement of the rams 16 and 22 and the spur gear 50. Alternatively, the pullys 70,74 and belt 72 may be replaced with a flexible shaft or other suitable coupling element for drivingly connecting the actuator 66 to the pinion 60.

Figure 4:
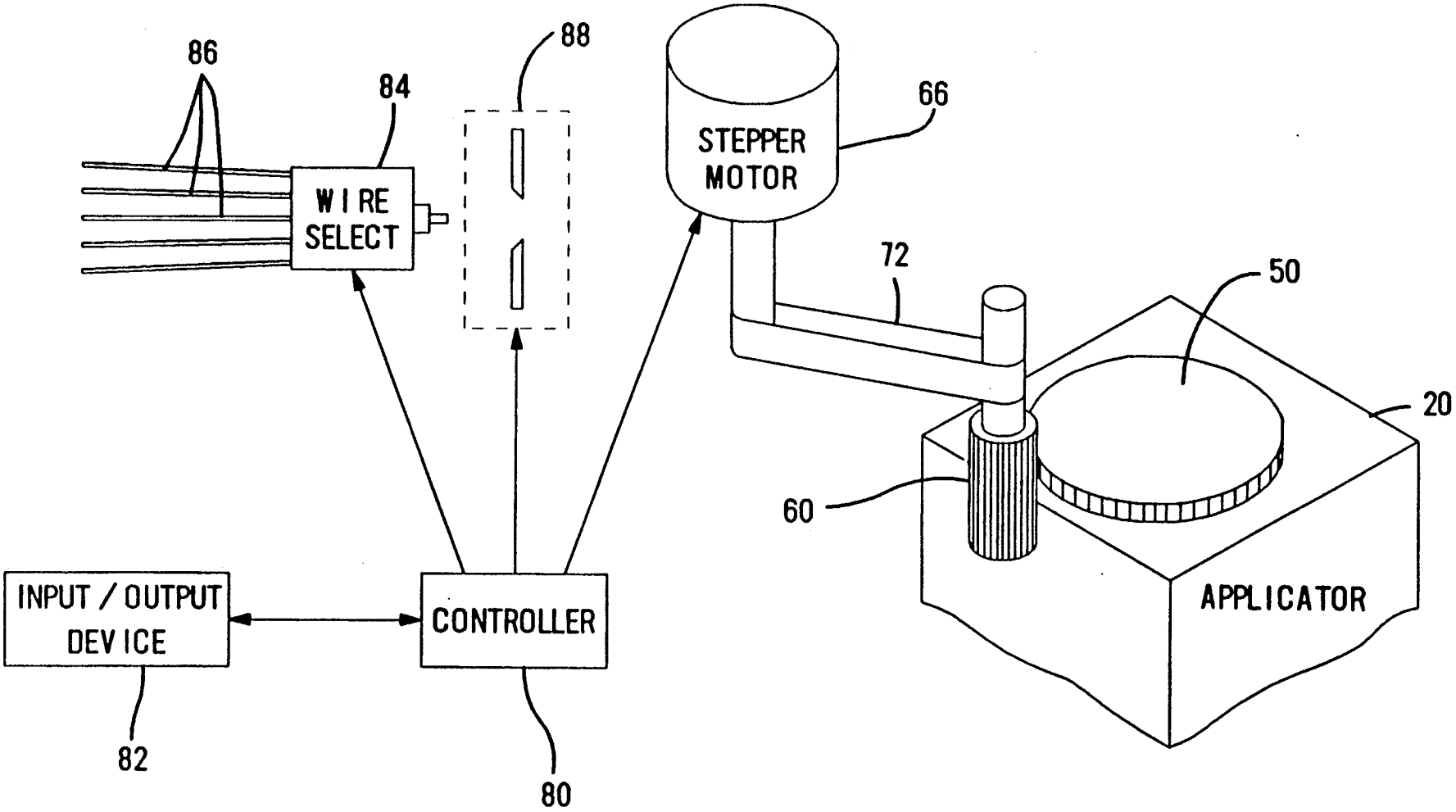
FIG. 4 is a block diagram showing the functional elements for controlling the insulation crimp height adjusting mechanism.

FIG. 4 shows the major functional elements of the machine 10 with respect to the present invention. A central controller 80, which in the present example is an IBM AT computer having a memory, is associated with the machine !0. An input/output device 82 is interconnected with the controller 80 for operator input into memory of various parameters as will be set forth below. The machine 10 includes a wire selecting device 84 of the type described in the above referenced U.S. Pat. No. 4,879,934, or similar device, which is arranged to select a desired wire from a plurality of wires 86 under control of the controller 80. Also included is a wire cutting and stripping device 88 which is positioned to strip insulation from the end of the selected wire preparatory to crimping a terminal onto the wire, and then to cut the wire to a desired length, again under control of the controller 80. Also included is a wire cutting and stripping device 88 which is positioned to strip insulation from the end of the selected wire preparatory to crimping a terminal onto the wire, and then to cut the wire to a desired length, again under control of the controller 80. The operation of the controller 80, input-/output device 82, wire selecting device 84, and wire cutting and stripping device 88 is set forth in the above referenced patent application Ser. No. 477,185. Similarly, the controller 80 is arranged to control the operation of the actuator 66. It will be understood that the automated machine 10 may have several applicators 20 each applying a different type of terminal under the control of the controller 80. Each such applicator 20 will have a corresponding actuator 66, belt 72, pinion 60, and spur gear 50.

In operation, parameters defining the plurality of wires 86, such as wire type, wire size, insulation type, et al., are entered into the controller's memory by means of the input/output device 82 along with the desired insulation crimp height for each unique wire type and terminal combination. Additionally, parameters defining the cable to be manufactured by the machine 10 are input into the controller's memory. During the production cycle the controller 80 provides a signal to the wire selecting device 86 to select a desired wire. The end of the selected wire is then presented to the wire cutting and stripping device 88 for insulation stripping as needed. The controller 82 then selects an applicator 20 having terminals as required for the cable being made and determines by retrieving from memory the insulation crimp height required for the given wire type and terminal combination. The controller 82 then signals the actuator 66 to position the operable control wheel 26 so that the pad 28 corresponding to the desired insulation crimp height is brought into alignment with the punch 36 to set the mechanism to the desired value for the insulation crimp height as already discussed above. The controller 80 then causes the prepared end of the selected wire to be presented to the applicator 20 containing a terminal, not shown, and the press ram 16 is caused to reciprocate downwardly in the usual manner causing the applicator ram 22 and punches 32 and 36 to reciprocate downwardly as well. Upon engagement with the anvils 30 and 34, the associated punches 32 and 36 crimp a portion of the terminal to the bare wire and another portion to the insulation of the wire respectively. The two rams 16 and 22 then reciprocate upwardly to their open position. During this downward and upward reciprocating movement, the spur gear 50 must follow the movement of the applicator ram 22 while maintaining operational engagement with the pinion gear 60 to assure that the insulation crimp height is not inadvertantly set to another value.

An important advantage of the present invention is the ability to automatically vary the insulation crimp height during the production cycle to correspond to the requirement of the particular wire type and terminal combination undergoing fabrication. This permits preprogramming the automated machine 10 to fabricate cables utilizing different wire types for a single given type of terminal on a particular applicator.

I claim:

1. In an automated machine for terminating a terminal to an insulated wire wherein said terminating includes crimping a portion of said terminal to the conductor of said wire and crimping another portion of said terminal to the insulation of said wire, said automated machine including a press having a base upon which an applicator is positioned, and a ram arranged for reciprocating motion toward and away from said base, said ram being operationally coupled to said applicator for effecting said crimping of both said portion and said another portion of said terminal, said applicator being arranged to crimp both said portions of said terminal, said applicator having an operable control for adjusting the insulation crimp height of said another portion of said terminal, said operable control arranged to undergo reciprocating motion in concern with said ram, means for automatically setting said operable control of said applicator to a desired insulation crimp height comprising:

(a) an actuator;

(b) coupling means for drivingly coupling said actuator to said operable control for effecting said adjusting;

(c) controller means for determining the desired insulation crimp height and for causing said actuator to effect said automatic adjusting of said operable control to said desired insulation crimp height.

2. The automated machine in accordance with claim 1 wherein said actuator is a rotary actuator for effecting rotary motion and said coupling means transmits said rotary motion into said operable control for effecting said automatic adjustment.

3. The automated machine in accordance with claim 2 wherein said coupling means includes a flexible element between said rotary actuator and said operable control.

4. The automated machine in accordance with claim 3 wherein said flexible element is a belt and said coupling means includes a first gear attached to said manually operable control and arranged for mutually concentric rotation and reciprocation therewith and a pinion gear in driving engagement with said first gear, said belt being in driving engagement with said pinion gear.

5. The automated machine in accordance with claim 4 wherein said pinion gear has a gear engaging operational length sufficient to permit said reciprocating motion of said manually operable control in concert with said ram while maintaining operational engagement of said pinion gear and said first gear.

* * * * *